US005540340A

United States Patent [19]

Betteley et al.

[11] Patent Number: 5,540,340

[45] Date of Patent: Jul. 30, 1996

[54] RACKING STORAGE SYSTEM

[75] Inventors: Colin E. Betteley, Rugeley; Nicholas Betteley, Walsall, both of England

[73] Assignee: Stakapal Limited, Cannock, England

[21] Appl. No.: 119,107

[22] PCT Filed: Mar. 18, 1992

[86] PCT No.: PCT/GB92/00483

§ 371 Date: Mar. 24, 1994

§ 102(e) Date: Mar. 24, 1994

[87] PCT Pub. No.: WO92/16126

PCT Pub. Date: Oct. 1, 1992

[30] Foreign Application Priority Data

Mar. 20, 1991 [GB] United Kingdom ..... 9105942

[51] Int. Cl.[6] ..... A47F 5/00

[52] U.S. Cl. ..... 211/183; 211/187; 211/191

[58] Field of Search ..... 211/183, 191, 211/192, 187, 189

[56] References Cited

U.S. PATENT DOCUMENTS

| | | | |
|---|---|---|---|
| 4,074,812 | 2/1978 | Skubic et al. | 211/191 X |
| 4,648,157 | 3/1987 | Schafer . | |
| 4,729,484 | 3/1988 | McConnell | 211/183 |
| 5,350,074 | 9/1994 | Rosenband | 211/191 X |
| 5,377,851 | 1/1995 | Asano et al. | 211/191 |

FOREIGN PATENT DOCUMENTS

| | | |
|---|---|---|
| 0176002 | 4/1986 | European Pat. Off. . |
| 2464676 | 3/1981 | France . |
| 3918796 | 12/1990 | Germany . |

*Primary Examiner*—Robert W. Gibson, Jr.
*Attorney, Agent, or Firm*—Hudak & Shunk Co., L.P.A.

[57] ABSTRACT

A post for racking comprises a front wall (2), and first and second side walls extending rearwardly from each longitudinal side of the front wall, the front wall having a longitudinally extending trough (7), and a first and a second series (5, 5') of spaced apertures (15) on opposite sides of the trough (7). Each side wall comprises a front wall portion (3, 3'), and a second side wall portion (4, 4'), with the two portions joined by an inwardly inclined portion (11, 11', 13 13'). The post is interchangeable with a number of posts having different load bearing capabilities. This is achieved by ensuring that the distant b separating outer faces (25) of the trough (7) from the outer faces (26) of the adjacent side walls are the same for all posts in the range.

13 Claims, 2 Drawing Sheets

RACKING STORAGE SYSTEM

This invention relates to racking and in particular to racking storage systems commonly referred to as pallet racking.

Pallet racking comprises a number of upright frames and a number of cross beams supported at least at one end by an upright frame. Additional fittings may be used to adapt the pallet racking for storage of a variety of articles such as drums, timber, piping, crates, etc.

Each upright frame comprises two uprights, upper and lower cross members and a number of diagonal braces extending between the two uprights. Each upright may comprise a single post or a number of posts connected by longitudinally extending joining means.

Typically each post is made of metal of a specified gauge and is manufactured in a rolling mill operation. In manufacture it is preferable to utilise a cross-section, or profile, which maximises the load bearing capability of the post for the gauge of metal selected. An additional consideration in selecting the profile, or profiles, to be used is that it may be desirable to connect posts of different load bearing capabilities. The profile or profiles selected should be such that compressive loads may be efficiently transmitted between the longitudinally joined posts without causing an increased likelihood of one of the posts buckling.

Numerous solutions to one or both of these problems have been proposed in the past and a wide variety of profiles are currently used in racking and storage systems, none of which are entirely satisfactory.

It is an aim of the present invention to provide a new form of profile for use in racking.

According to a first aspect the invention consists in a post for racking comprising a front wall, first opposed side wall portions extending rearwardly from the front wall, and second opposed side wall portions extending rearwardly of and substantially parallel to the first side wall portions being joined thereto by inwardly inclined portions, the front wall being provided with a longitudinally extending rearwardly directed trough, and a first and a second series of spaced apertures disposed on opposite sides of the trough.

An advantage of a post according to the invention is that the trough strengthens the post, particularly by increasing resistance of the front wall to buckling.

Preferably the trough is centrally located in the front wall and is equi-spaced between the first and second series of apertures.

In a preferred form the second side wall portions may be spaced apart by a distance equal to the width of a diagonal brace which may be secured between the second side wall portions when the post is incorporated in a racking storage system.

Preferably each second side wall portion is provided with a series of apertures, the apertures in each portion being opposed and adapted to receive a bolt or other fixing means to secure a brace to the post.

The second side wall portions may each be provided with an outwardly projecting flange extending from a rear edge of the second side wall portion.

In one form of the post each inwardly inclined portion may be substantially parallel to the front wall. Alternatively it may be angled relative to the front wall.

In a preferred embodiment the first and second series of apertures may be arranged such that apertures in the first and second series are aligned. Advantageously each aperture may have a shape which is symmetrical about a transverse axis. This has a particular advantage in that a post having such apertures may be reversible which means that the orientation of the post is not critical during construction of the upright frame thereby facilitating construction of the racking storage system.

In one preferred form the apertures may have an elongated octagonal shaped perimeter.

It may be desirable to manufacture a range of posts having varying load bearing capabilities. A problem which has been encountered with existing ranges of posts is that whilst a connector joined to a cross beam may interlock securely with one post in the range it may interlock less securely with another post in the same range having a different load bearing capability.

According to a second aspect the invention consists in a range of posts having different load bearing capabilities, each post having a front wall, and first and second opposed side walls, each side wall extending rearwardly from a respective longitudinal side of the front wall, each side wall comprising a first side wall portion extending rearwardly from the front wall, a second side wall portion extending rearwardly of and substantially parallel by the respective first side wall portion, being joined thereto by an inwardly inclined portion, the front wall having a longitudinally extending rearwardly directed trough comprising first and second side portions and a rear face spaced rearwardly from the front wall, and a first and a second series of spaced apertures disposed on opposite sides of the trough, each post in the range being so constructed and arranged that an outer face of one of the first side wall portions and an outer face of the adjacent first side portion of the trough are separated by a distance which is equal to a distance separating an outer face of the other first side wall portion and an outer face of the adjacent second side portion of the trough, and is the same for all posts in the range.

An advantage of a range according to the second aspect of the invention is that a connector which interlocks securely with one post in the range will interlock securely with all the posts in the range.

A suitable connector for use with a range of posts in accordance with the invention may comprise a front flange provided with a series of projections adapted to locate in one of the series of apertures in the front wall of the post, a first side flange adapted to engage against the outer face of the first side portion of the trough, and a second longer side flange adapted to engage against the outer face of the first side wall.

In a preferred form of post the trough is centrally located in the front wall and each series of apertures is equi-spaced from the trough.

Advantageously posts may be made of different gauges of metal to provide posts having different load bearing capabilities.

Preferably as well as the distance between the outer face of the first side portion of the trough and the outer face of the first side wall remaining constant throughout the range, other dimensions may also be fixed such as the distance between the outer faces of the first and second side walls.

The invention will now be further described, by way of example only, with reference to the accompanying drawings of which:

Figure 1:
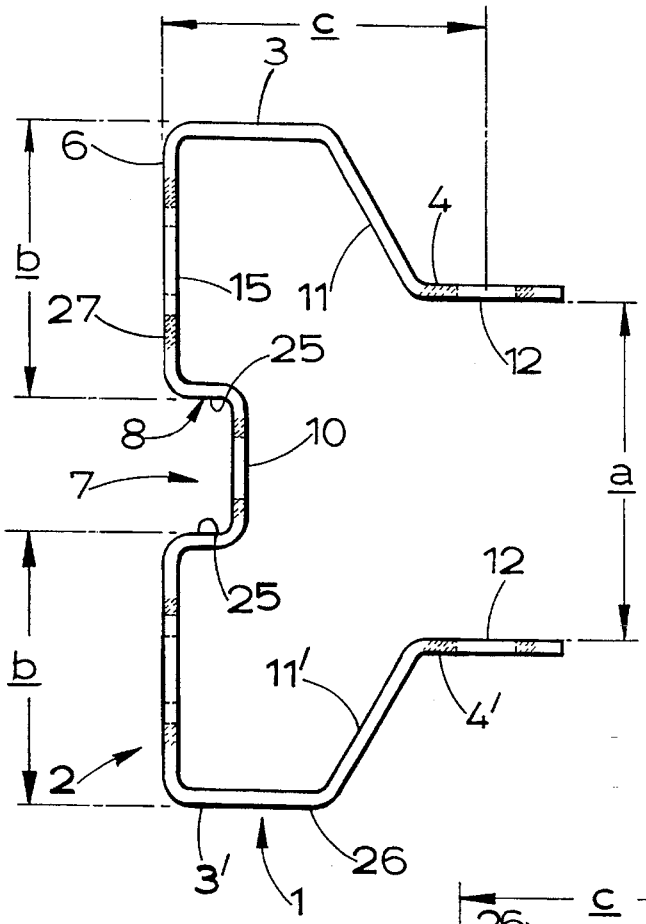
FIG. 1 is a cross-section of a post in accordance with the invention.
Figure 2:
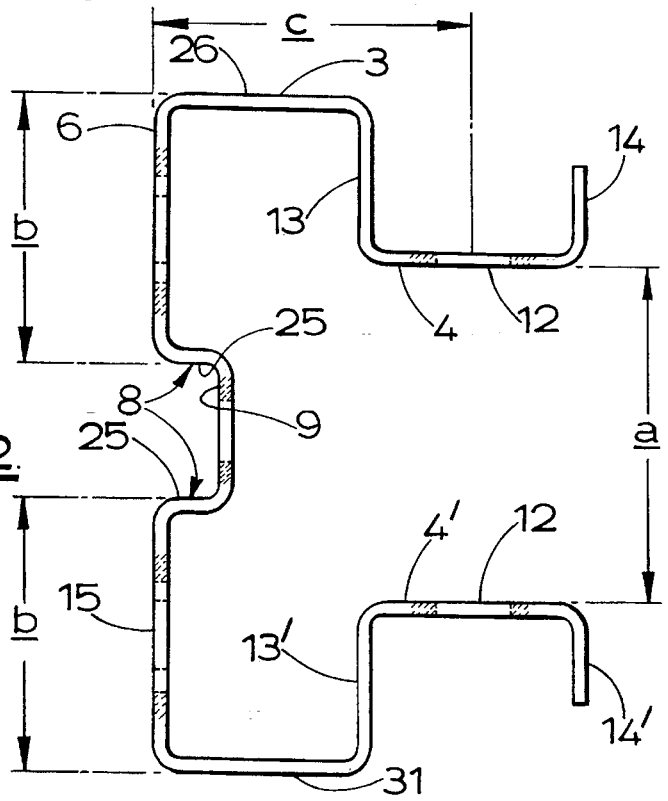
FIG. 2 is a cross-section of a modified post.
Figure 3:
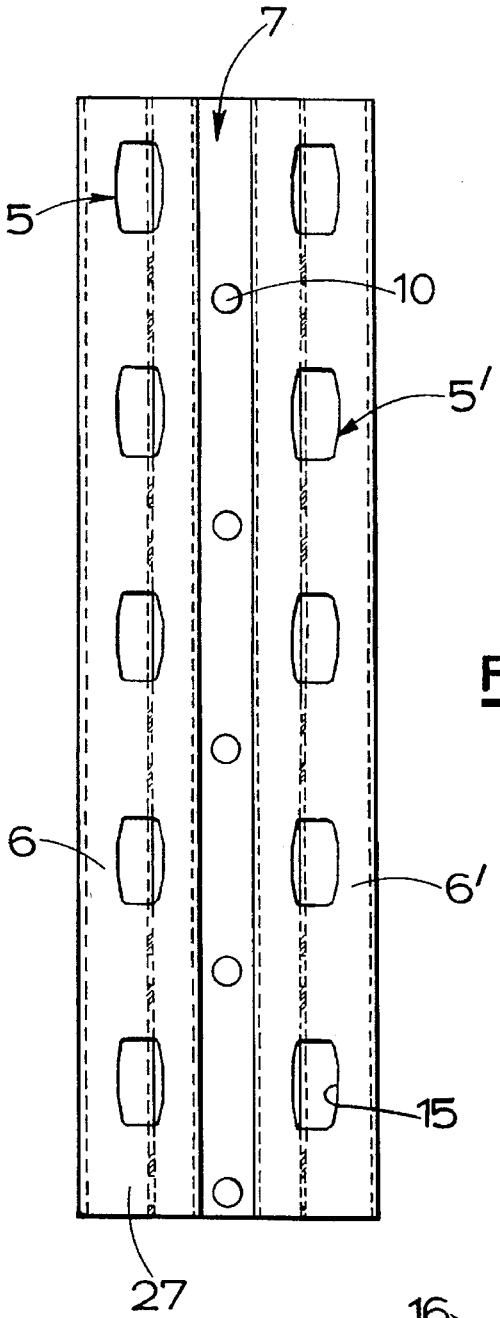
Figure 4:
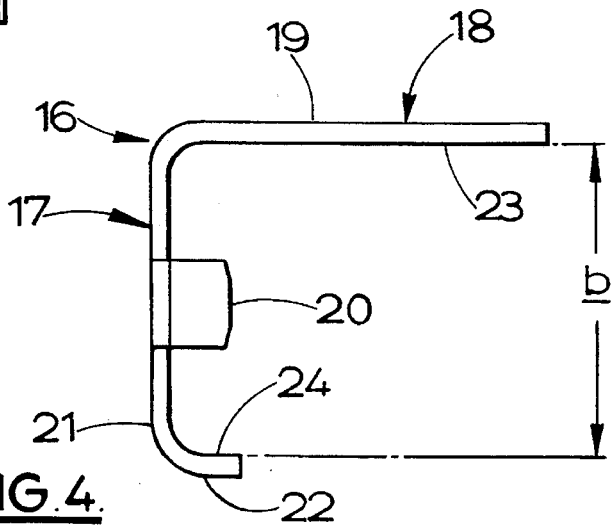

FIG. 3 s a front view of a section of the post illustrated in FIG. 1 or FIG. 2; and FIG. 4 is a cross-section of a connector suitable for use with a post in accordance with the invention.

A post 1 illustrated in FIGS. 1–3 of the drawings comprises a front wall 2, first opposed side wall portions 3,3' extending rearwardly from the front wall and second opposed side wall portions 4,4' extending rearwardly of and substantially parallel to the first side wall portions. The front wall has a first and second series 5,5' of spaced apertures located adjacent longitudinally extending side regions 6,6' from which the first side wall portions 3,3' extend. A longitudinally extending trough 7 is centrally located in the front wall and comprises first side portions 8 and a rear face 9. The trough is equi-spaced from each series of apertures 5,5' which are located on opposite sides of the trough. A number of round holes 10 are located in the rear face 9 of the trough.

In the post shown in FIG. 1, each second side wall portion 4,4' is joined to the respective first side wall portion by an inclined portion 11,11', the inclined portion being angled at substantially 60° relative to the front wall. The second side wall portions are separated by a distance a and are adapted to receive a diagonal brace (not shown) therebetween, the distance a being such that sides of the brace are closely abutted by the second side wall portions. A series of opposed apertures 12 is located centrally in each second side wall portion 4,4'. A sufficient number of apertures 12 are provided to enable braces to be fixed to the post at suitable intervals. A suitable method of fixing the brace to the post is by passing a bolt through the aligned apertures and through a suitable aperture or other fixing means in the brace. Alternatively the brace may be welded in position.

FIG. 2 shows a modified post made of a heavier gauge metal in which the front wall 2, trough 7 and first side wall portions 3,3' correspond to those of the embodiment shown in FIG. 1. The second side wall portions 4,4' extend rearwardly of and substantially parallel to the first side wall portions 3,3'. Inclined portions 13,13' joining the second side wall portions to the first side wall portions are angled such that they are substantially parallel to the front wall. Again the second side wall portions are separated by a distance which is such that a brace is snugly received between the second side wall portions 4,4'. As in the post of FIG. 1 a number of aligned apertures 12 centrally located in each of the second side wall portions 4,4' are adapted to receive a bolt to secure a brace to the post. An outwardly extending flange 14,14' is provided at the free end of each second side wall portion 4,4' remote from the inclined portion 13.

As can be seen best in FIG. 3 the front wall of a post is provided with a first and second series 5,5' of apertures 15, each series 5,5' extending along a length of post adjacent a side region 6,6'. Each aperture 15 is symmetrical about a transverse axis and is shaped like a longitudinally elongated octagon. Since the apertures 15 are symmetrical and each series 5,5' is equi-spaced from the centrally located trough 7 the post may be incorporated into an upright frame with either end orientated upwards, thus facilitating construction of the upright frame.

An L-shaped connector 16 adapted to be used with the posts previously described is illustrated in FIG. 4. The L-shaped connector comprises a front flange 17 and a first side flange 18, to an outer face 19 of which a cross member may be secured by welding or other fixing means. The front flange is provided with a series of hook-like projections 20 adapted to extend in use rearwardly and downwardly through one of the series of apertures 15 to secure the connector to the post. At an end 21 remote from the first side flange the front flange has a longitudinally extending second side flange 22 adapted to be received in use in the central trough 7 of a post.

The connector is dimensioned such that an inner face 23 of the first side flange 18 and an inner face 24 of the second side flange 22 are separated by a distance b which is the same distance as that between an outer face 25 of the first side portion 8 and an outer face 26 of the first side wall portion 3 of the post described above with reference to FIG. 1 or FIG. 2 of the accompanying drawings.

It can be seen that this distance b is the same in both embodiments of post illustrated. In a range of posts produced of varying gauges of metal this dimension b is kept constant, inner dimensions of the post varying with the gauge of metal utilised. A connector which is dimensioned to fit securely on one post in the range will fit any of the posts in the range, which is a great advantage in terms of simplicity and adaptability.

In producing a range of posts, the distances b and a are kept constant, the distance b being the most important. It may also be desirable to keep other distances constant throughout the range such as a distance c between a front face 27 of the front wall and an axis of the apertures 12 in the second side wall portions 4,4'. In addition the total distance between the outer faces 26 of the first side wall portions is constant throughout the range.

We claim:

1. A post for racking comprising a front wall, first opposed side wall portions extending rearwardly from the front wall, and second opposed side wall portions extending rearwardly of and substantially parallel to the first side wall portions being joined thereto by inwardly directed portions, the front wall being provided with a longitudinally extending rearwardly directed trough and a first series and a second series of spaced apertures disposed on opposite sides of the trough, wherein each second side wall portion is provided with a series of apertures, the apertures in each said served side wall portion being opposed and adapted to receive a bolt or other fixing means to secure a brace to the post.

2. A post according to claim 1, wherein the trough is centrally located in the front wall and is equi-spaced between the first and second series of apertures.

3. A post according to claim 1, wherein the second side wall portions are spaced apart by a distance equal to the width of a diagonal brace which is adapted to be secured between the second side wall portions when the post is incorporated in a racking storage system.

4. A post according to claim 1, wherein each second side wall portion is provided with an outwardly projecting flange extending from a rear edge of the second side wall portion.

5. A post according to claim 4, wherein each inwardly inclined portion is parallel to the front wall.

6. A post according to claim 1, wherein each inwardly inclined portion is angled with respect to the front wall, and the two inclined portions converge in a direction extending rearwardly with respect to the front wall.

7. A range of posts for racking having different load bearing capabilities, each post having a front wall, and first and second opposed side walls, each side wall extending rearwardly from a respective longitudinal side of the front wall, each side wall comprising a first side wall portion extending rearwardly from the front wall, a second side wall portion extending rearwardly of and substantially parallel to the respective first side wall portion, being joined thereto by an inwardly directed portion, the front wall having a longitudinally extending rearwardly directed trough comprising first and second side portions and a rear face spaced rearwardly from the front wall, and a first series and a second series of spaced apertures disposed on opposite sides of the trough, each post in the range being so constructed and arranged that an outer face of one of the first side wall portions and an outer face of the adjacent first side portion of the trough are separated by a distance which is equal to a distance separating an outer face of the other first side wall portion and an outer face of the adjacent second side portion of the trough, and is the same for all posts in the range, wherein each second side wall portion of each post is provided with a series of apertures, the apertures in each said second side wall portion being opposed and adapted to receive a bolt or other fixing means to secure a brake to the post.

8. A post according to claim 7, wherein the trough is centrally located in the front wall.

9. A post according to claim 7, wherein each series of apertures is equi-spaced from the trough.

10. A post according to claim 7, wherein the first and second series of apertures are aligned.

11. A post according to claim 7, wherein each aperture has a shape which is symmetrical about axis which are mutually normal to each other.

12. A post according to claim 7, wherein each aperture has an elongate octagonal shaped perimeter.

13. A post according to claim 12, wherein each aperture is elongate in a longitudinal direction, the side edges of the aperture, defining abutments for projections on a pair of connectors, and inclined edges at the lower ends of the side edges defining a wedging engagement with the projections.

* * * * *